United States Patent [19]

Cudd

[11] Patent Number: 4,870,841

[45] Date of Patent: Oct. 3, 1989

[54] LOCK DEADBOLT PROTECTOR

[75] Inventor: Charles A. Cudd, Duluth, Ga.

[73] Assignee: Yale Security Inc., Monroe, N.C.

[21] Appl. No.: 254,170

[22] Filed: Oct. 6, 1988

[51] Int. Cl.[4] ..... E05B 59/00

[52] U.S. Cl. ..... 70/107; 292/169.13; 292/33

[58] Field of Search ..... 70/107; 292/33, 34, 292/36, 40, 169.13

[56] References Cited

U.S. PATENT DOCUMENTS

Re. 26,677 10/1969 Russell ..... 70/107

1,663,572 3/1928 Stuart ..... 292/169.13

FOREIGN PATENT DOCUMENTS 9128 of 1905 United Kingdom ..... 292/169.13

*Primary Examiner*—Robert L. Wolfe

*Attorney, Agent, or Firm*—Dallett Hoopes

[57] ABSTRACT

Mortise lock has a guardbolt which, when depressed, moves a hooked lever inside the lock housing from a first position in which it blocks operation of the deadbolt operator, to a second position in which it clears the deadbolt operator and permits it to operate. This protects against extension of the deadbolt unless the door is closed.

2 Claims, 1 Drawing Sheet

LOCK DEADBOLT PROTECTOR

BACKGROUND OF THE INVENTION

1. Field of the Invention

This invention relates to a mortise lock. More specifically, this invention relates to a mortise lock having means preventing the throwing of the deadbolt until a guardbolt is first depressed.

2. Description of the Related Art Including Information Disclosed Under §§1.97–1.99

The prior art is, of course, replete with examples of mortise locks generally comprising a rectangular housing adapted to fit into an opening in the end of the door at waist level, and generally containing a latch and a separate deadbolt and operating means for both of them. The operating means for the latch is generally in the form of a rotatable cam which is driven by a handle. For the deadbolt the operating means is usually a turnbolt on the inside of the door and a key cylinder from the outside of the door.

It has been common to use such mortise locks in the doors of guest rooms in hotels and the like with the latch bolt automatically locking when the door is closed so that the door may be opened from the hallway, only by a key operating the lock cylinder. Mortise locks to such guest rooms have also included a deadbolt operated by a turnbolt from inside the guest room.

A problem has been experienced in the past in that the guest room maid in a hotel in making up the room has abused the deadbolt. As is conventional, the linen supply for the guest rooms is brought to the hallway outside a room on a wheeled supply cart, and it is from such a cart that the maid services the room. In servicing the room the maid will strip the beds of their soiled sheets and carry them out through the door. Although the maid has a key for the room, in order to avoid having to use the key to gain readmittance to the guest room, the maid will before leaving the room simply throw the deadbolt by turning the turnbolt and then let the door close on her way out. Because the deadbolt is extended, it will engage the door frame, keeping the door from closing and therefore unlatched. Later, loaded with fresh linens, the maid will merely push the door open to get back into the room.

The above-described way of operating, while saving the maid energy and time, has been hard on both the deadbolt and the door frame, because hotel doors, generally being heavy, have relatively heavy-duty closers which will drive the door toward closed position, causing a severe impact of the deadbolt on the frame.

In the past, when because of the damage caused the maid is confronted and criticized for throwing the deadbolt, she has often proclaimed her innocence, saying that it was accidental. As a result, attempts have been made in the past to make it more difficult to throw the deadbolt with the door open. An example of such an attempt is found in the U.S. Pat. Re. No. 26,677 (copy enclosed) from a patent which issued on Aug. 22, 1967 to F. J. Russell et al. In this mortise-type lock an auxiliary bolt is provided having an inward horizontal arm which carries on it a blocking element which, unless the auxiliary latch is depressed, blocks the downward movement of a special linkage pivoted to the crank arm of the deadbolt operator. The mechanism of the resissue patent has been improved upon by providing a simpler and more easily operatable structure.

SUMMARY OF THE INVENTION

Under the present invention the mortise lock is provided with a special guardbolt. Inside the mortise housing a lever is mounted, pivoted intermediate its ends. One end is accessible to the inner end of the guardbolt while the other end is formed with a hook. The adjacent deadbolt operator carries, spaced from its axis, a transverse pin. The lever may take one of two positions: the first position with the hook engaging the pin and blocking the extension of the deadbolt, and the second position clearing the pin. The lever is shiftable from the first to second position by depressing the guardbolt.

As a result, with the door closed and the strike depressing the guardbolt, the hook clears the pin and the deadbolt is throwable in the conventional manner by the guest. With the door open and the guard-bolt extended, the lever is in its first position with the hook blocking the operation of the deadbolt. Thus, if a maid intends to throw the deadbolt with the door open, she would have to first manually depress the guardbolt. As a consequence, it is much more difficult for her to plead that the objectionable setting of the deadbolt was "accidental".

BRIEF DESCRIPTION OF THE DRAWINGS

Other objects and features of the invention will be apparent from the following specification and drawings, all of which disclose a non-limiting embodiment of the invention. In the drawings.

DESCRIPTION OF THE PREFERRED EMBODIMENT

Figure 1:
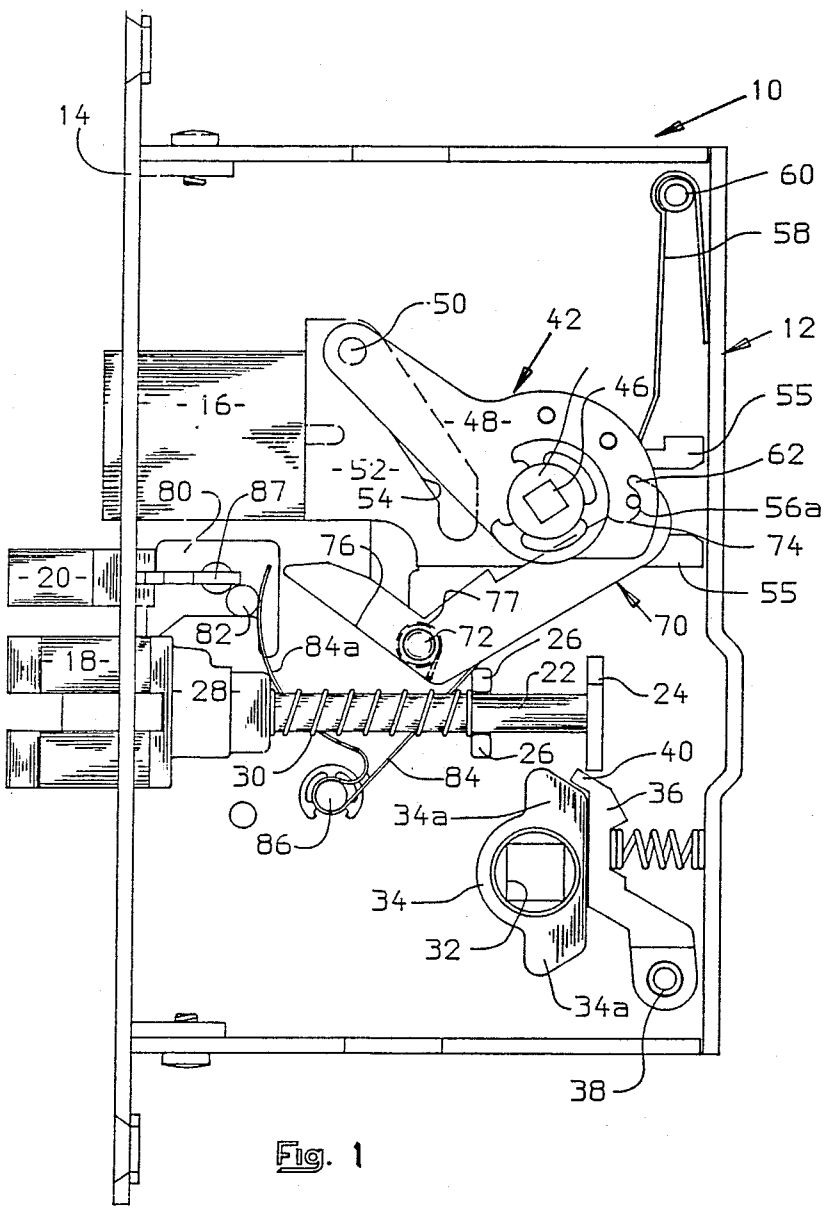
FIG. 1 is a simplified view of a mortise lock embodying the invention showing the lever in the first position.

A mortise lock embodying the invention is generally designated 10 in FIG. 1. As shown with its cover removed, the lock includes a rectangular housing 12 having an apertured face plate 14 with its ends extending beyond the ends of the housing to be mounted against the end of the door as is conventional.

Extending through the aperture in the face plate 14 are the deadbolt 16, the latchbolt 18 and the guardbolt 20. Inside the housing the latchbolt 18 has a rearward reciprocable latch shaft 22 having a pull-back plate 24 on its inner end. A pair of projections 26 in the wall of the housing supports the latch shaft 22 in proper alignment. The shaft is enlarged as at 28 adjacent the latch 18, and an axial spring 30 is disposed intermediate the projections 26 and the enlargement 28 to bias the latch outward.

The spindle of the door handle (not shown) is square in shape and engages a square-shaped opening 32 in a pull-back 34 mounted for rotation between the side walls of the housing. The pull-back is formed with projections **34*a* which work against the latchbolt-operating lever 36, pivoted as at 38 in the housing. A nose 40 on the latchbolt lever 36 engages the plate 24 when the pull-back is operated to retract the latchbolt, as is conventional. By using the latch-operating lever 36 the "throw" of the pull-back 34 is increased so that for limited turning of the latch handle (not shown) the latchbolt 18** is completely retracted.

The deadbolt operator 42 is mounted on a hub 44 journaled in aligned openings in the side walls of the housing 12. The hub is formed with a square opening 46 to receive the square spindle of a turnbolt (not shown). The operator 42 is provided with an arm 48 which carries on its distal end a cam follower 50. The deadbolt 16 has attached to its inner end a drive plate 52 having an elongated cam slot 54 disposed on an incline therein. The drive plate 52 has a pair of legs 55 which for support of the drive plate straddle the hub 44 of the operator in the conventional arrangement. When the turnbolt (not shown) is turned, it rotates the operator 42 so that the follower 50, moving downward, slides along the cam slot 54, propelling the deadbolt 16 outward. In the retraction of the deadbolt the turnbolt is turned in the opposite direction and the arm 48 raises, causing the follower 50 to move upward in the cam slot 54, once again retracting the deadbolt.

Spaced from the hub 44 and secured to the operator 42 is a plurality of pins 56 and 56*a*. The pins extend between the operator plate shown and an identically shaped plate parallel and behind it. A hairpin-shaped spring 58 has one arm disposed against the side wall of the housing and loops over a screw boss 60 in the upper corner of the housing. The other arm of the spring 58 is formed with an inward deflection 62 which serves, when the deadbot is retracted, to press downward on the lower pin 56a to hold the operator in retracted position.

Above the deadbolt operating mechanism in the case 12 there is room for the conventional key-operated cylinder (not shown) having an operating lever which will engage the deadbolt operator so that the deadbolt may be operated from outside the door with a key.

Figure 2:
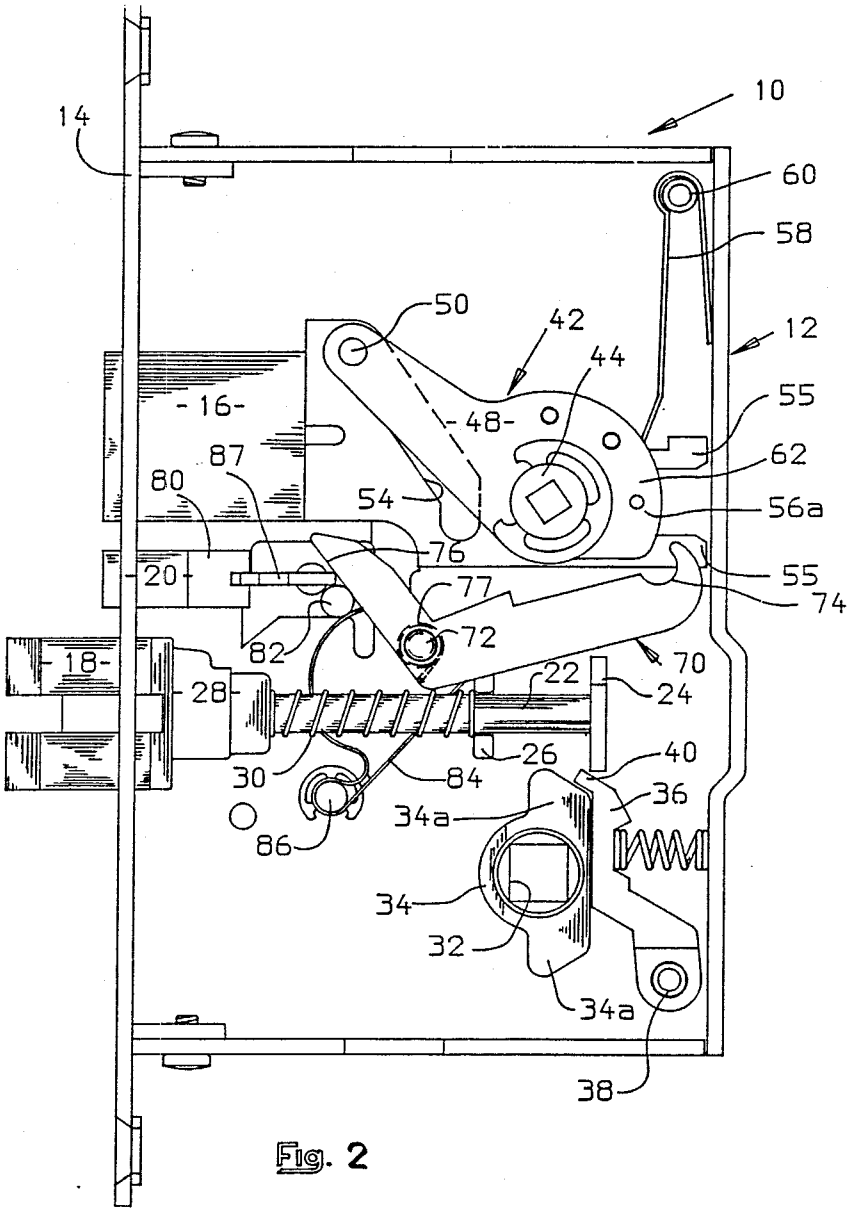
FIG. 2 is similar to FIG. 1 but shows the lever in the second position.

Turning now to the focus of the invention, a lever 70 is disposed in the housing and pivoted intermediate its ends on a pin 72 rigidly supported between the side walls of the housing. At the inner end of the lever is a hook 74, and at the other end is a working surface 76. The lever 70 is capable of taking two positions. In its first position the lever has its hook 74 engaging around the pin 56*a*, blocking the counterclockwise rotation of the operator 42 (FIG. 1). In its second position (FIG. 2) the lever has its hook well clear of the pin 56*a*. An axial spring 76 surrounding the pin 72 biases the lever 70 towards the first position.

Completing the assembly is a plate 80 mounted on the inner end of the guardbolt 20. The plate carries an upward nib 82, and a wire spring 84 has one end engaging a projection 26, loops about a pin 86 formed in the back wall of the housing, and a second arm which applies outward pressure against the pin 82 on the plate 80, the arm 84*a* being well beneath the lever of the working surface 76 on the lever.

Extending perpendicular to the plate 80 is a fin 87 which, when the guardbolt 20 is pressed inward against the force of spring 84, engages the working surface 76 to move the lever 70 into second position, freeing the operator 42 to throw the deadbolt out. It should be clear that the guardbolt 20 can be depressed either manually or by engaging a strike on the frame of the door when the door is closed. Either of the ways of depressing the guardbolt results in the liberation of the pin 56*a* from the hook 74.

It will be clear to those skilled in the art that the present invention greatly simplifies and makes more reliable than disclosures in the art the blocking of operation of a mortise lock deadbolt until the guardbolt is forced inward.

While the invention has been disclosed in only one form, it should be clear it is not so limited but is capable of many variations and modifications within the scope of the following claim language and equivalents thereof which define the invention.

What is claimed is:

1. A mortise lock comprising
   a. a box-like housing having an apertured face plate adapted to be mounted in the end surface of a door
   b. an outwardly biased latchbolt protruding through the face plate
   c. an operator for said latchbolt
   d. a deadbolt mounted in the housing for reciprocation through the face plate
   e. an operator for the deadbolt comprising:
      (1) a drive body mounted in the housing for rotation about an axis perpendicular to the door, the body having pins on its periphery and parallel to its axis, the deadbolt operator being connected to the body at its axis,
      (2) a link connecting one of the pins to the end of the deadbolt,
   f. a guardbolt mounted in the housing for reciprocation through the face place
   g. deadbolt blocking means comprising:
      (1) an outwardly biased auxiliary latchbolt normally extending through the end plate,
      (2) a lever pivoted intermediate its ends in the housing and having a hook on one end adapted when the lever is in a first position to hook around one of the pins in the body to block the operator from turning, and in a second position to clear said pin to permit turning of the operator, part of the lever being accessible to the inner end of the guardbolt, whereby when the guardbolt is moved inward as by engagement with a door strike or by manual manipulation it moves the lever from first to second position.

2. A mortise lock as claimed in claim 1 wherein the body comprises a pair of spaced aligned end plates having the pins extending between the end plates.

* * * * *